United States Patent [19]

Tseng

[11] Patent Number: 5,013,960

[45] Date of Patent: May 7, 1991

[54] CHRISTMAS TREE LIGHT WITH SEPARATION WEDGE

[76] Inventor: Jeow N. Tseng, No. 539, Sec. 4, Chung Hua Rd., Hsin Chu City, Taiwan, R.O.C.

[21] Appl. No.: 519,411

[22] Filed: May 4, 1990

[51] Int. Cl.[5] ..... H01J 5/48

[52] U.S. Cl. ..... 313/318; 313/316; 313/317; 439/619; 362/226

[58] Field of Search ..... 313/316, 317, 318; 439/602, 611, 619, 699; 362/226, 806

[56] References Cited

U.S. PATENT DOCUMENTS 4,870,547 9/1989 Crucefix ..... 362/227

4,970,632 11/1990 Tseng ..... 362/226

*Primary Examiner*—Donald J. Yusko

*Assistant Examiner*—Diab Hamadi

*Attorney, Agent, or Firm*—Steinberg & Raskin

[57] ABSTRACT

A Christmas tree light consisting of a bulb with two leads extending from its lower end, a hollow seat, and a separation wedge. The hollow seat has an upper seat portion and a lower seat portion. A slot runs lengthwise along the lower end of the lower seat portion for receiving and frictionally engaging with the separation wedge.

1 Claim, 3 Drawing Sheets

CHRISTMAS TREE LIGHT WITH SEPARATION WEDGE

BACKGROUND OF THE INVENTION

The present invention relates generally to Christmas tree lights, and in particular relates to a Christmas tree light which has a separation wedge at its lower end for separating, guiding, and orienting the leads of the bulb.

In the past, Christmas tree lights essentially consisted of a bulb (a), a seat (b) which was substantially cylindrical and a rectangular insert (e), as shown in FIGS. 3 and 4. From the lower end of the bulb (a), two leads (conductor wires) protruded. During installation of the bulb (a) in the seat (b), the leads (c) first had to be properly positioned so as to protrude from the respective openings (d) formed by the rectangular insert (e). If the orientation of the leads (c) was a little bit off, then the leads (c) were easlily forced into the inner cavity of the seat (b) by the insertion of the rectangular insert (e), thus rendering the entire light unusable. A second problem with the prior art Christmas tree lights was that even after the leads (c) protrude from the openings (d), they still must be bent around to the lateral sides of the lower portion of the seat (b), as shown in FIG. 3. If the leads (c) did not coincide with the lateral sides of the lower portion of the seat, then they will not conduct properly.

SUMMARY OF THE INVENTION

It is a primary objective of the present invention to provide a Christmas tree light with a wedged shaped separation wedge at the lower end thereof for automatic separation and orientation of the leads of the bulb.

It is another objective of the present invention to provide such a Christmas tree light in which the leads further automatically protrude from the lateral face of the lower portion of the seat during assembly.

Further objectives and advantages of the present invention will become apparent as the following description proceeds, and the features of novelty which characterize the invention will be pointed out with particularity in the claims annexed to and forming a part of this invention.

These and additional objects, if not set forth specifically herein, will be readily apparent to those skilled in the art from the detailed description provided hereinbelow, with appropriate reference to the accompanying drawings.

BRIEF DESCRIPTION OF THE DRAWINGS

FIG. 2-A is a view taken along line A—A of FIG. 2, with the seat portion thereof cutaway;

DETAILED DESCRIPTION OF THE PREFERRED EMBODIMENT

Figure 1:
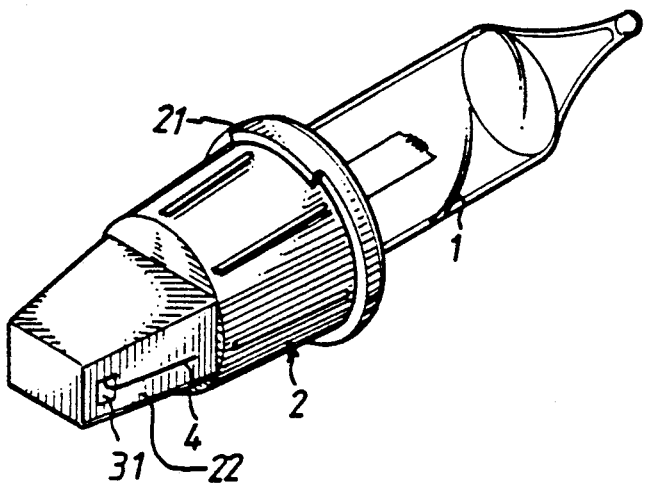
FIG. 1 is a perspective view of the Christmas tree light of the present invention.
Figure 2A:
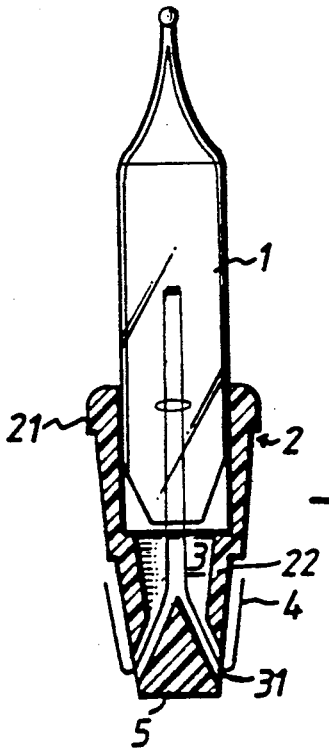
FIG. 2 is an elevational view of the Christmas tree light of FIG. 1.
Figure 2:
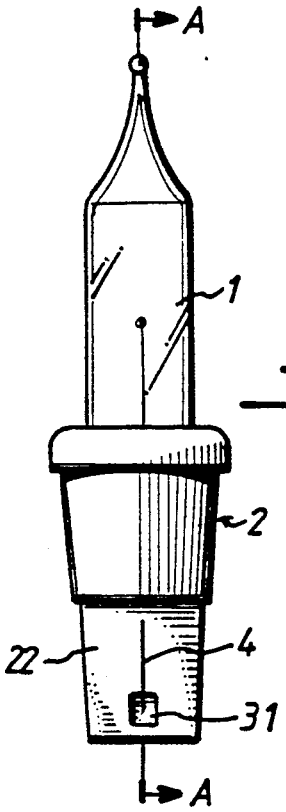
Figure 3:
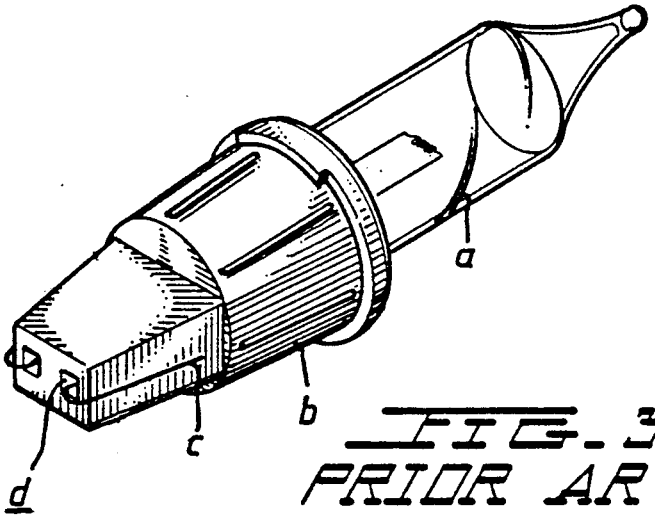
FIG. 3. PRIOR ART
FIG. 3 is a perspective view of a prior art Christmas tree light.
Figure 4:
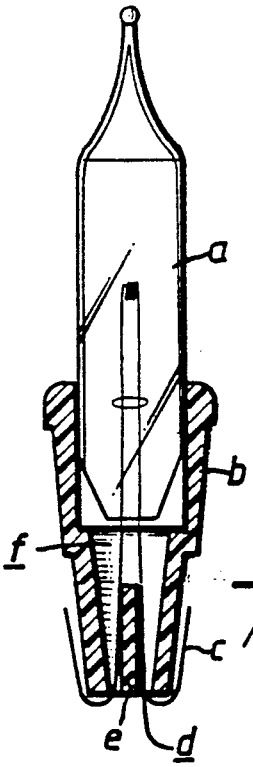
FIG. 4. PRIOR ART
FIG. 4 is a partially cutaway view of the prior art Christmas tree light of FIG. 3.

Referring to FIGS. 1, 2, and 2-A, it can be understood that the Christmas tree light of the present invention comprises a bulb 1, a hollow seat 2, and a substantially triangular separation wedge 5. The hollow seat 2 has two integral but distinct parts, the upper seat 21, which is substantially cylindrical in shape, and the lower seat 22, which is substantially rectangular in shape.

As in conventional Christmas tree lights, the present Christmas tree light comprises a bulb 1 with two leads 4 extending from a lower end thereof and a hollow seat 2.

The lower portion of the lower seat has a lengthwise slot 3 which extends to the two lateral sides of the lower seat 22. The separation wedge 5 frictionally engages in the lengthwise slot 3 so as to form respective openings 31 at the lateral sides of the lower seat 22. These openings can best be seen from FIG. 2-A. The length of the lower end of the separation wedge coincides with the length of the lengthwise slot 3 so that when assembled together, the lower and lateral surfaces of the lower seat 22 will be flush with the separation wedge 5.

During assembly, the leads 4 protrude from the lower portion of the lower seat 22, as shown in FIG. 1. When the separation is inserted into the lengthwise slot 3, the leads 4 are automatically separated into opposite directions and will protrude from respective openings 31 which are formed by the insertion of the separation wedges, and can easily be bent upwards as shown in FIGS. 2 and 2-A.

While the present invention has been explained in relation to its preferred embodiment, it is to be understood that various modifications thereof will be apparent to those skilled in the art upon reading this specification. Therefore, it is to be understood that the invention disclosed herein is intended to cover all such modifications as shall fall within the scope of the appended claims.

I claim:

1. A Christmas tree light comprising a bulb (1) with two leads extending from a lower end thereof and a hollow seat (2), said hollow seat (2) comprising a substantially cylindrical upper seat (21) and a substantially rectangular lower seat (22), the improvement comprising:

(a) a lengthwise slot (3) extending to two lateral sides of said lower seat (22); and (b) a substantially triangular separation wedge (5) which frictionally engages in said lengthwise slot (3) so as to form respective openings (31) at said lateral sides of said lower seat (22).

* * * * *